US007131282B2

(12) United States Patent
Karlsson et al.

(10) Patent No.: US 7,131,282 B2
(45) Date of Patent: Nov. 7, 2006

(54) DEFROSTING

(75) Inventors: Arne Karlsson, Motala (SE); Ingemar Hallin, Lidingö (SE); Carl Lindhagen, Motala (SE); Fredrik Reithe, Linköping (SE); Anton Lundqvist, Älvsjö (SE)

(73) Assignee: Dometic Sweden AB, Solna (SE)

( * ) Notice: Subject to any disclaimer, the term of this patent is extended or adjusted under 35 U.S.C. 154(b) by 285 days.

(21) Appl. No.: 10/758,175

(22) Filed: Jan. 15, 2004

(65) Prior Publication Data

US 2005/0115252 A1 Jun. 2, 2005

(30) Foreign Application Priority Data

Dec. 1, 2003 (SE) ..... 0303227

(51) Int. Cl.
*F25B 15/00* (2006.01)

(52) U.S. Cl. ..... 62/141; 62/154; 62/186; 62/408

(58) Field of Classification Search ..... 62/141, 62/154, 186, 272, 408, 441, 476
See application file for complete search history.

(56) References Cited

U.S. PATENT DOCUMENTS

| | | | | | |
|---|---|---|---|---|---|
| 3,874,193 | A | * | 4/1975 | Reistad | 62/490 |
| 4,197,717 | A | | 4/1980 | Schumacher | |
| 4,258,554 | A | * | 3/1981 | Asselman et al. | 62/175 |
| 4,375,750 | A | * | 3/1983 | Blomberg | 62/101 |
| 4,660,385 | A | * | 4/1987 | Macriss et al. | 62/57 |
| 5,231,844 | A | | 8/1993 | Park | |
| 5,557,941 | A | | 9/1996 | Hanson et al. | |
| 5,966,951 | A | * | 10/1999 | Hallin et al. | 62/141 |

FOREIGN PATENT DOCUMENTS

EP 0 707 183 A2 10/1995

* cited by examiner

*Primary Examiner*—Melvin Jones
(74) *Attorney, Agent, or Firm*—Pearne & Gordon LLP

(57) ABSTRACT

The present invention relates to an apparatus and method for defrosting an absorption refrigerator comprising the steps of determining a defrost start time for defrosting of the low temperature compartment and higher temperature compartment, starting the absorption refrigerating system at the defrost start time independent of other control parameters determining start and stop of the absorption refrigerating system, detecting stop of the absorption refrigerating system, applying heat to the first tube section using the first heater, detecting end of low temperature compartment defrosting, starting the absorption refrigerating system after end of low temperature compartment defrosting, and applying heat to the second tube section using the second heater.

19 Claims, 5 Drawing Sheets

DEFROSTING

TECHNICAL FIELD

The present invention relates to automatic defrosting of an absorption refrigerator and a method therefore. More specifically the present invention relates to automatic defrosting of an absorption refrigerator in an efficient and reliable manner and a method therefore.

BACKGROUND OF THE INVENTION

The present invention relates to an absorption refrigerator including; a cabinet having outer walls and at least one door encasing a low temperature storage compartment and a higher temperature storage compartment, said compartments being separated by a partition wall, and an absorption refrigerating system including an evaporator tube in which a refrigeration medium flows from an upstream end to a downstream end of the evaporator tube, and which evaporator tube comprises a first tube section which is arranged to absorb heat from the low temperature compartment, a second tube section, which is arranged to absorb heat from the higher temperature compartment, wherein the first and second tube sections are connected in series and the first tube section is arranged upstream of the second tube section. An absorption refrigerator having only a low temperature compartment, that is a freezer, is also contemplated in relation to the present invention.

Such absorption refrigerators are commonly used e.g. in recreation vehicles, mobile homes or at homes were AC power supply is not available at all times.

Normally, at the prior art refrigerators of this type, the lower temperature compartment is a freezer, which at modern absorption refrigerators normally is maintained at −18° C.

The low temperature compartment is occasionally denoted freezer or freezer compartment, the higher temperature compartment is occasionally denoted fridge or fridge compartment and the cabinet, comprising the freezer and fridge compartments are occasionally denoted refrigerator, absorption refrigerator or refrigerator cabinet.

The freezer may also accommodate a device for fabrication of ice, often referred to as the ice-maker. The ice maker may in it's simplest form be an ice-cube container but it may also comprise more sophisticated devices with means for automatic water supply and ice harvesting means including mechanical members and electrical heating elements.

The higher temperature compartment is normally maintained at around +5° C. and could be referred to as a fridge compartment.

The evaporator tube may include an upstream tube section, which is dedicated for cooling the ice-maker, if present.

Downstream of this ice-maker tube section and in direct connection to its downstream end, an intermediate tube section is arranged for cooling the freezer. Downstream of the freezer section, a downstream refrigerator section of the evaporator tube is arranged for cooling the higher temperature fridge compartment. At some applications both the freezer and the ice-maker are cooled together by one single evaporator tube section which is arranged upstream of the fridge tube section.

The evaporator may be provided with various types of heat conducting members for conducting heat from the items to be cooled, i.e. the freezer and refrigerator compartments and the ice maker, to the respective evaporator tube sections. As an example, the ice-maker section of the evaporator may be provided with a heat conducting plate, which is arranged to support the ice-cube container and which conducts heat from the container to the ice-maker section of the evaporator. The freezer and fridge sections may be provided with flanges or baffles, which conduct heat from the air in the freezer and fridge compartments to the evaporator freezer and fridge section respectively.

The evaporator reaches its lowest evaporation temperature at the upstream end. Downstream of the upstream end, the evaporation temperature rises gradually when the cooling medium in the evaporator tub absorbs heat from the ice-maker, freezer compartment and fridge compartment.

A problem at this known type of absorption refrigerator is that it is difficult to achieve a high enough cooling power of the refrigeration system to maintain the freezer compartment at the low temperature which is desired. As mentioned above, it is often desired to keep the temperature in the freezer compartment as low as approximately −18° C. The total cooling power of the absorption refrigerating apparatus is, among other factors, limited by the heat transfer capacity of the evaporator, which in turn depends on the total length of the evaporator tube. This length in turn, is limited by the dimensions of the refrigerator cabinet and by the fact that the evaporator tube needs to be designed with a downward inclination over its entire length, from the upstream to the downstream end.

Defrosting of a refrigerator, being a compressor refrigerator or an absorption refrigerator, including a freezer and/or ice-maker or not, is always a delicate task since it involves application of heat to a compartment which should be kept cold. In the type of absorption refrigerators mentioned above the application of heat is possibly more troublesome than else since the cooling capacity may be limited according to what is entioned above. Moreover, electronics, such as heaters, fans, control system etc, in such refrigerators are often driven by battery, which is shared with other RV (recreational vehicle) appliances, limiting the available power.

Consequently, it is important to achieve an effective automatic defrosting having as low heat impact as possible to the fridge and freezer compartments and consuming as little power as possible.

SUMMARY OF THE INVENTION

It is a main object of the present invention to provide such apparatus and method that at least alleviate the above problems.

It is in this respect a particular object of the invention to provide such apparatus and method that achieves a reliable and effective defrosting of an absorption refrigerator.

It is still a further object of the invention to provide such apparatus and method that achieves a reliable and effective defrosting of an absorption refrigerator having a freezer compartment and possibly a fridge compartment, which are cooled by a single absorption refrigerating system.

It is still a further object of the invention to provide such apparatus and method that achieves defrosting with less heat application to individual compartments in the refrigerator than prior art systems and using less power than prior art systems, specifically for absorption refrigerators.

These objects among others are, according to a first aspect of the present invention, attained by a method for defrosting an absorption refrigerator including a cabinet having outer walls and at least one door encasing a low temperature storage compartment. The refrigerator further comprises an absorption refrigerating system including an evaporator tube in which a refrigeration medium flows from an upstream end to a downstream end of the evaporator tube, and which evaporator tube comprises a first tube section which is arranged to absorb heat from the low temperature compartment and a first heater provided to heat the first tube section.

The method comprises the steps of determining a defrost start time for defrosting of the low temperature compartment, starting the absorption refrigerating system at the defrost start time independent of other control parameters determining start and stop of the absorption refrigerating system, detecting stop of said absorption refrigerating system, applying heat to said first tube section using said first heater, detecting the temperature of said first tube section, starting said absorption refrigerating system, and detecting end of low temperature compartment defrosting.

According to another version of the invention said absorption refrigerating system is started when the temperature of said first tube section has reached a threshold.

This threshold value may be selected so that the absorption refrigerating system is started a short time before the defrosting of the low temperature compartment is finished, so that the absorption refrigerating system gets a head start. Since the absorption refrigerating system is a slow started the threshold is selected so that cooling power do not reach the low temperature compartment before the defrosting is finished.

According to another version of the invention the absorption refrigerator comprises a higher temperature storage compartment, said low and higher temperature compartments eing separated by a partition wall, at least a second tube section, which is arranged to absorb heat from the higher temperature compartment, and a second heater provided to heat said second tube section. The method comprises the steps of determining a defrost start time for defrosting of said low temperature compartment and higher temperature compartment and applying heat to said second tube section using said second heater after heat has been applied to said low temperature compartment.

In this respect it should be noted that detecting temperature on the first and second tube sections should be interpreted to also include detecting the temperature indirectly, for instance by detecting the temperature on a heat exchanger mounted on said tube section, or detecting the temperature in the immediate neighborhood of the heat exchanger or tube section.

The above objects among others are, according to a second aspect of the present invention, attained by an absorption refrigerator comprising means to perform the steps according to the first aspect above.

By the method and apparatus above a defrosting of an absorption refrigerator is achieved which is effective and reliable. By starting the cooling system before applying heat to the freezer compartment it is guaranteed that the temperature in the freezer compartment is not to high for defrosting. By starting the cooler system before applying heat to the fridge compartment, cooling of the freezer compartment is not delayed while defrosting of the fridge compartment continues. The inventive realisation that it will take some time before the cooling power reaches the fridge compartment due to the slow reaction of the absorption system and that defrosting of the fridge compartment would normally be finished before the cooling power reaches the fridge compartment allows this arrangement. The fact that the defrosting of the fridge compartment is slowly starting at the stop of the cooling system and is ongoing during the defrosting of the freezer compartment is further shortening the time needed for application of heat in the fridge compartment and thus aids the above arrangement.

According to another version a battery is arranged to supply power to the electronics in an absorption refrigerating system, such as fans, heaters, control system etc, during at least part of the operating time of the absorption refrigerator.

According to another version a control system is provided to control start and stop of the absorption refrigerating system and thereby the temperature in at least the higher temperature storage compartment to be within a specified temperature range.

The control system also monitors battery voltage and controls and monitors heating elements, fans etc in the refrigerator.

According to another version a delay is introduced between the step of detecting stop of the absorption refrigerating system and the step of applying heat to the first tube section.

Thereby the cooling power generated by the cooler is allowed time to cool the freezer and fridge compartments and the first tube section is allowed to warm up somewhat before applying heat.

According to another version detecting of the end of low temperature compartment defrosting is performed by detecting the temperature on the first tube section and detecting if a specified time period has elapsed and determining if the temperature is above a threshold or if the specified time period has elapsed. If the temperature in the first tube section is above a defined threshold, with a suitable selected temperature threshold such as between 0° C. to +20° C., specifically 2° C. to 10° C., preferably 5° C., it is likely that ice formed on the first tube section has melted when the temperature threshold is reached. A maximum time period for application of heat to the first tube section is preferably defined. At end of low temperature compartment defrosting the power to the first heater is turned off.

According to another version applying heat to the second tube section is performed when the start-up sequence for the absorption refrigerating system is finished.

End of the start-up sequence could for instance be when heat is applied to the cooler.

According to another version applying heat to the second tube section is commenced when heat application to the first tube section is ceased.

According to another version application of heat to the second tube section is performed while the absorption refrigerating system is operating and is providing cooling power to the refrigerator.

By running the cooler during application of heat to the fridge compartment a head start is achieved for cooling down the freezer compartment. This is important since heat has been applied to the freezer compartment and thus the temperature in the freezer compartment can be expected to be higher than wanted. Application of heat to the second tube section will still remove ice formations on the second tube section, despite that the cooler is running, since the absorption refrigerating system is a slow system and the cooling power first reaches the freezer. Moreover, since the cooler has been off during the application of heat in the freezer compartment, the fridge compartment, and more specifically the second tube section, have had time to warm up a bit, reducing the time needed for application of heat to the second tube section for removing ice. Delaying the start of the heaters in the fridge compartment to when start-up of the cooler has finished reduces DC-power peak consumption, and a successful start of the cooler is guaranteed before continuing the defrosting of the refrigerator.

According to another version the end of higher temperature compartment defrosting is detected by detecting the temperature on the second tube section and detecting if a specified time period has elapsed and determining if the temperature is above a threshold or if the specified time period has elapsed.

If the temperature in the second tube section is above a defined threshold, with a suitable selected temperature threshold such as between 0° C. to +20° C., specifically 2° C. to 10° C., preferably 5° C., it is likely that ice formed on the second tube section has melted when the temperature threshold is reached. A maximum time period for application of heat to the second tube section is preferably defined. At end of higher temperature compartment defrosting the power to the second heater is turned off.

According to another version the absorption refrigerator comprises water drain pipes and/or drip trays, wherein at least one heating element is arranged in the water drain pipes and/or drip trays. Normal thermostatic operation is resumed after the step of detecting end of higher temperature compartment defrosting and power is applied to the at least one heating element arranged in the water drain pipe.

Power may be applied to the heater in the water drain pipes and/or drip trays during application of heat to first and second tube sections.

According to another version the application of heat to the at least one heating element in the water drain pipe is stopped after a specific time period.

After ice has been removed from the first and second tube section it is important to lead the water out of the fridge and freezer compartment. By warming the drain pipes the water is allowed time to flow and freezing of the water is prevented.

According to another version a defrost start time is determined by selecting a defrost start time once every 24 hours.

According to another version the air temperature in the low temperature compartment, the time the absorption refrigerator has been switched on, availability of cooling energy source and battery voltage is detected. The defrosting is then postponed or aborted if the air temperature in the low temperature compartment is above a specified temperature, if the absorption refrigerator has been on shorter than a specified time, if no cooling energy source is available or if the battery voltage is below a specified voltage level.

According to another version an extra defrosting cycle is scheduled if end of defrosting of the low temperature compartment is determined by lapse of the specified time period.

According to another version the battery voltage is detected during the defrosting and the defrosting is aborted immediately if the battery voltage level falls under a specified voltage threshold.

According to another version the low temperature compartment comprises a fan, and a defrost start time determined by detecting if the fan is blocked and start of defrosting is started immediately if the fan is blocked.

According to another version the fan in the low temperature compartment is started intermittently and kept on for a short duration during the defrosting of the low temperature compartment. By intermittently starting the fan for short periods, the fan is kept operational and is prevented from getting stuck due to ice formation on the fan.

Determination of a start time for defrosting according to the present invention may be performed in many ways. A straightforward way is to defrost the refrigerator once every 24 hours. When defrosting should be performed during these 24 hours may simply be set to for instance 03:00 AM or may be the task of elaborated schemes involving for instance door opening frequency during the 24 hours, temperature in the refrigerator, the temperature outside of the refrigerator etc. Other things may affect the start or stop of defrosting, such as the status of the fan in the freezer compartment, the battery voltage, the success or failure of earlier defrosting, the temperature in the fridge or freezer, the operating time of the refrigerator etc. These things may postpone a scheduled defrosting, introduce a new defrosting before the next 24 hour defrosting or abort an ongoing defrosting.

According to a version first and second fans are provided in the freezer and fridge compartments, respectively, to circulate cool air from the first and second tube sections to a storage area in the compartments. The first and second fans are turned off during application of heat to the respective first and second tube sections to avoid heat transfer to respective storage areas. According to an alternative only the freezer comprises such a fan for circulating air. The fan in the freezer compartment is turned on when the temperature in the freezer has reached a predetermined value.

Further characteristics of the invention and advantages thereof will be evident from the following detailed description of embodiments of the invention.

BRIEF DESCRIPTION OF THE DRAWINGS

The present invention will become more fully understood from the detailed description of embodiments of the present invention given herein below and the accompanying FIGS. 1 to 8, which are given by way of illustration only, and thus are not limitative of the present invention.

PREFERRED EMBODIMENTS

Figure 1:
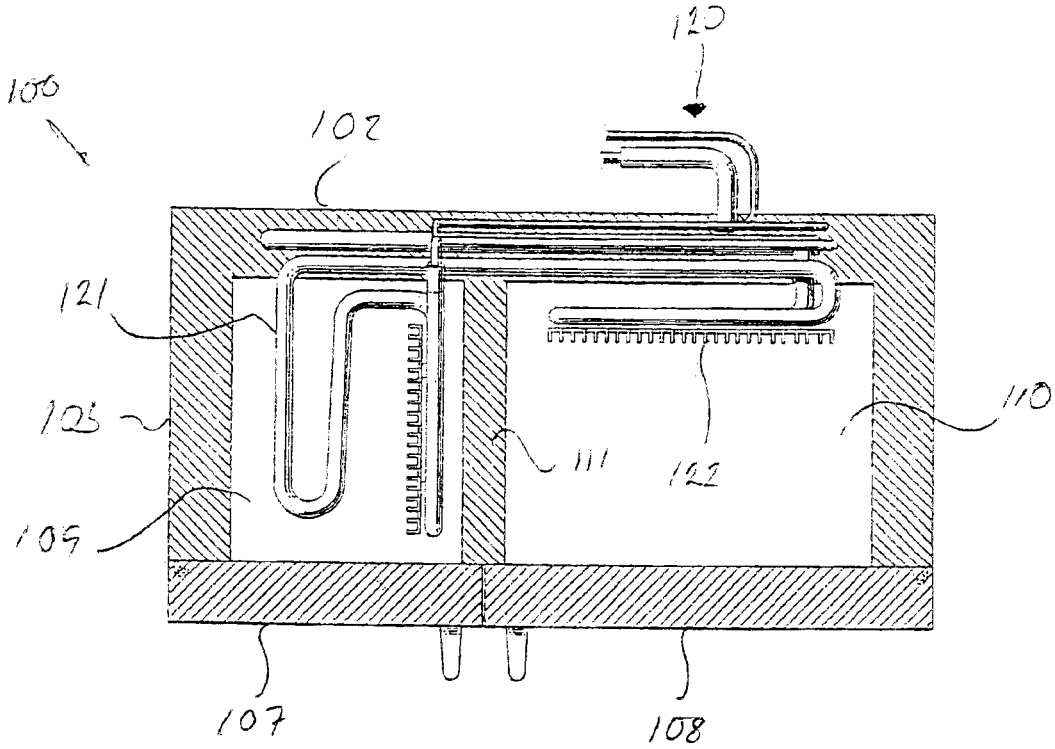
FIG. 1 is a top elevation view, with parts of the walls broken away, of a refrigerator cabinet according to the present invention.

In the following description, for purposes of explanation and not limitation, specific details are set forth, such as particular techniques and applications in order to provide a thorough understanding of the present invention. However, it will be apparent to one skilled in the art that the present invention may be practiced in other embodiments that depart from these specific details. In other instances, detailed descriptions of well-known methods and apparatuses are omitted so as not to obscure the description of the present invention with unnecessary details.

In the figures a side-by-side absorption refrigerator 100 is shown. The cabinet includes a rear wall 102, and two side walls 103, 104. A top-wall and a bottom-wall is also included but not shown in FIG. 1. These outer walls, together with two front doors 107, 108 enclose a low temperature storage compartment 109 and a higher temperature storage compartment 110. The outer walls and the front doors 107, 108 all include an outer and an inner shell between which heat-insulating material, such as polyurethane foam, is arranged. The two compartments 109, 110 are hermetically sealed from each other by a vertical partition wall 111, which extends perpendicular to and from the rear wall 102, between the rear wall 102 and the front of the cabinet 100, in such away that the doors 107 and 108, when closed, sealingly rest against the front of the partition wall 111. The front door 107, the partition wall 111, the sidewall 103 and respective portions of the rear wall, top wall and bottom wall thus define the freezer compartment 109. The front door 108, the partition wall 111, the sidewall 104 and respective portions of the rear wall, top wall and bottom wall analogously define the higher temperature compartment 110. The partition wall is placed approximately ⅓ of the total width of the cabinet from one sidewall 103, so that the width-relationship between the freezer compartment 109 and the refrigerator compartment 110 is approximately 1:2.

During operation, the temperature in the freezer compartment 109 is normally kept at about −18° C., whereas the higher temperature compartment 110 normally is kept at about +5° C. The higher temperature compartment 110 could also be referred to as a refrigerator compartment, or fridge.

An absorption refrigerator system including a conventional boiler, condenser, and absorber (neither of which is shown in FIG. 1) is arranged at the back of the cabinet, outside the rear wall 102. The refrigerator system also includes an evaporator, generally indicated by reference number 120. The evaporator 120 is formed of an evaporator tube, which includes a first evaporator tube section 121 for cooling the freezer compartment 109 and a second evaporator tube section 122 for cooling the higher temperature compartment 110. The first section 121 is arranged inside the freezer compartment 109 and the second section 122 inside the higher temperature compartment 110 at a lower elevation than the first section so that cooling liquid may be transported from the first section 121 to the second section 122 by gravity.

It should be noted that in this description the term first and second tube section are used to indicate a section of the evaporator tube designed to supply cold to, or rather to take up heat from, a specific part of the refrigerator. In the design of this tube section the skilled man would, in his normal design work, use for instance heat exchangers and other normal design choices such as specific lay-outs of the tubing as is disclosed in FIG. 1, to increase the heat exchange capabilities. Thus, such heat exchangers and/or lay-outs are intended to be included in the term tube section, so that the term tube section also could include for instance a heat exchanger.

Figure 2:
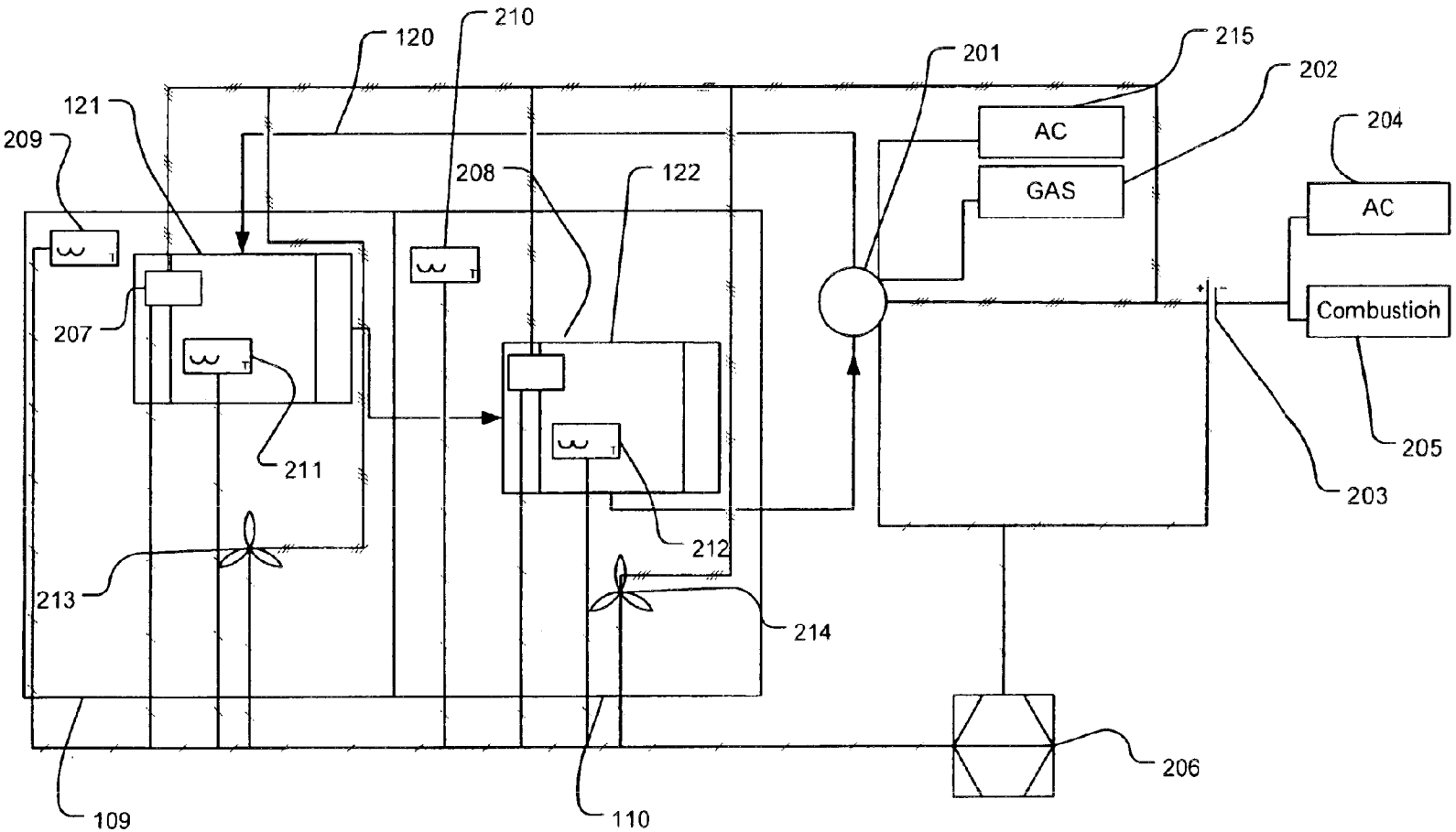
FIG. 2 is a schematic block diagram of a preferred embodiment according to the invention.

FIG. 2 is a schematic block diagram of the invention according to a preferred embodiment. An absorption refrigerator system is schematically disclosed and denoted 201. The refrigerator system 201 includes a conventional boiler, condenser, and absorber, as well as any other conventional technology for the operation of the refrigerator system 201. A gas source 202, an AC-source 215 and a battery 203 are connected to the refrigerator system 201 in a conventional manner.

The battery 203 may be charged through mains 204 or through a connection to a generator on a combustion engine 205, for instance on a motor vehicle. During charging of the battery 203 the voltage level of the battery 203 is higher than when no charging occurs. A computer, or a control system 206, measures the voltage level of the battery. The battery is further connected to a first heating element 207, provided on the first evaporator tube section 121, for providing power to the heating element 207 and to a second heating element 208, provided on the second evaporator tube section 122, for providing power to the second heating element 208. The heating elements 207 and 208 are primarily provided to achieve automatic defrosting of the freezer compartment 109 and the higher temperature compartment 110. The first heating element may for instance have a nominal power of 70 W at 12 volt and the second heating element may for instance have a nominal power of 40 W at 12 volt.

The control system 206 is further connected to the refrigerator system 201 for controlling the start and stop of the refrigerator system 201 and to the first and second heating elements 207 and 208 for controlling the application of heat to the freezer compartment 109 and the higher temperature compartment 110, respectively. A first temperature-measuring device 209 is provided in the freezer compartment 109 for measuring the air temperature in the freezer compartment 109. A second temperature-measuring device 210 is provided in the higher temperature compartment 110 for measuring the air temperature in the higher temperature compartment 110. Third and fourth temperature-measuring devices 211 and 212, are provided to measure the temperature on the first and second tube section, respectively. All four temperature-measuring devices are connected to the control system 206 through respective signal lines. The temperature-measuring devices may for instance be resistors, thermistor or thermocouple. The measurement range may for instance be −25° C. to +5° C., with an accuracy of +/−1° C. for air temperature in the freezer compartment and −5° C. to +8° C., with an accuracy of +/−0.5° C. for air temperature in the fridge compartment. The measurement range for the temperature-measuring devices provided on the first and second tube sections may for instance be −25° C. to +15° C., with an accuracy of +/−2° C.

Furthermore, a first and a second fan, 213 and 214, are provided in the low temperature compartment and the higher temperature compartment, respectively. The first and second fans are powered by the battery 201 and are connected to the control system 206.

The operation of the absorption refrigerator according to the invention will now be described with reference to FIGS. 3 to 8.

Figure 3:
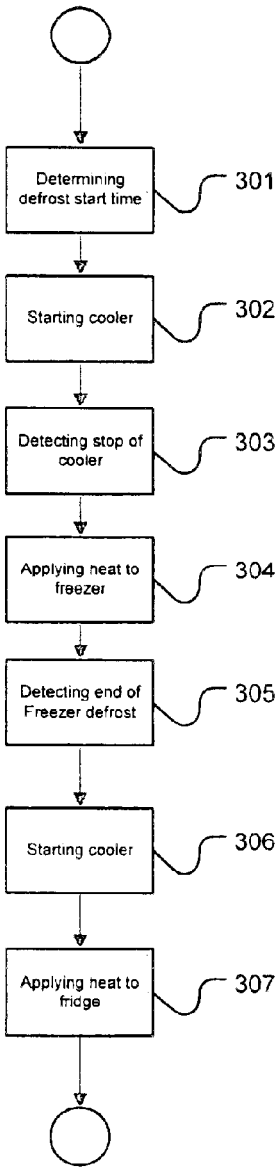
FIG. 3 is a schematic flow diagram of a preferred embodiment according to the invention showing the general defrosting algorithm.

FIG. 3 is a schematic block diagram according to a preferred embodiment of the invention showing the general defrosting algorithm. In a first step 301 determination of a defrost start time is performed. Defrosting is generally performed once every 24-hour period. The specific time of day at which defrosting should take place can depend on a number of variables, such as when the door is least frequently opened, or simply be set to for instance 02:00 AM. If a static approach is used the time may be set once, and step 301 would for instance involve comparison with a real time clock or any other suitable means for determining start of defrosting. Other influences may also have impact on the determination of start of defrosting as will be described further below.

At start of defrosting the absorption refrigerating system, or cooler 201 is started 302. The cooler 201 is started independent of the normal operation of the refrigerator system as controlled by the control system 206, which of course also controls the defrosting algorithm. The cooler 201 is now allowed to cool the absorption refrigerator according to normal operating conditions and eventually the cooler 201 is stopped when the temperature in the higher 110 and/or lower 109 temperature compartment is low enough. This event is monitored in step 303.

When the cooler 201 is stopped, heat is applied 304 by the heating element 207 provided on the first tube section in the low temperature compartment 109, in this disclosure also denoted freezer. During application of power to the heating element 207 the first fan 213, provided to transport cool air in the freezer compartment 109, is stopped. The first fan 213 is kept off at least as long as the temperature on the first tube section 121 is higher than the air temperature. Heat is also applied to water drain pipes and/or drip trays in the freezer.

In step 305 the end of defrosting of the freezer compartment 109 is monitored and when this event is detected the cooler is started 306. After the cooler is started 306, for the second time, heat is applied 307 to the second tube section 122 in the higher temperature compartment 110, in this disclosure also denoted fridge, by the heating element 208. The combination of the freezer compartment 109 and the fridge compartment 110 is herein occasionally denoted refrigerator.

This will have the effect that the cooler is running at the same time heat is applied by the second heating element 208 to the second tube section 122. In other words the defrosting is ongoing in the fridge 110 at the same time as the cooler 201 is operating. Since absorption coolers in general is slow starters, that is, it will take some time for the system to draw heat from the refrigerator, and since the freezer is first in the refrigerating system 120, and thus will receive the initial cooling power, this will pose no problem. Indeed the early start of the cooler 201 is beneficial since the freezer 109 need not to "wait" for defrosting of the fridge 110 before being cooled down after defrosting.

Figure 4:
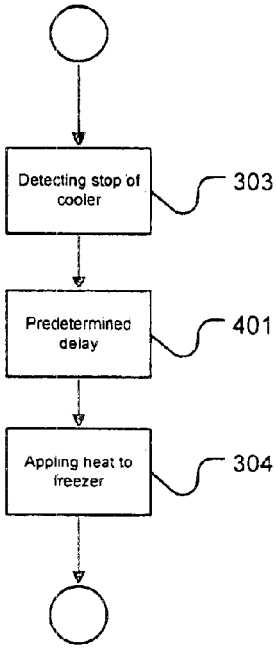
FIGS. 4 to 8 are schematic flow diagrams according to embodiments of the present invention.

Additionally, as is disclosed in FIG. 4, a delay step 401 may be included before application of heat to the first heating element 207. This delay is for giving the cooling power generated by the cooler 201 time to fully cool the refrigerator, and is due to the fact that the absorption refrigerating system 201 is a slow cooling system. Thus, the temperature on the first tube section 121, will initially be rather low, but will increase, after stop of the cooler 201. By delaying the application of heat by the heating element 207 valuable DC-power may be saved.

Figure 5:
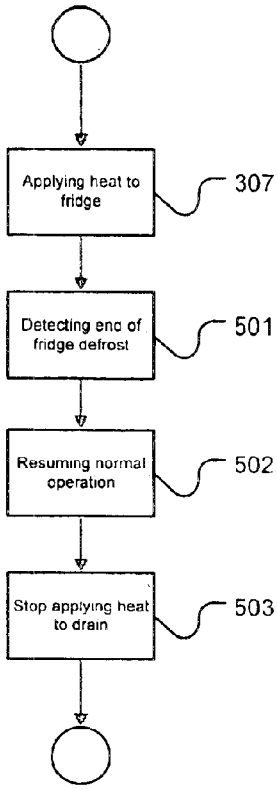

According to an embodiment disclosed in FIG. 5, the end of defrosting of the fridge compartment 110 is detected at step 501. Detecting the temperature on the second tube section 122, using the fourth temperature-measuring device 212, performs this and if the temperature is below a threshold the heat application step 307 is ended. If the temperature has not reached the specified threshold after a predetermined time, the heating element 208 is turned off.

After end of defrosting of the fridge compartment 110 the control system resumes normal thermostatic operation 502, with the exception that heaters provided in water drain pipes are kept on. This is of course to allow defrost water from the first and second tube sections to be drained so that the water is not left in the refrigerator. After a predetermined time the heaters in the water drain pipes is turned off 503. During normal thermostatic operation the start and stop of the cooler 201 is controlled by the control system to keep the temperature in the freezer 109 and fridge 110 within specific and respective ranges. During defrosting, as described in this disclosure, these temperature ranges may occasionally be violated.

Figure 6:
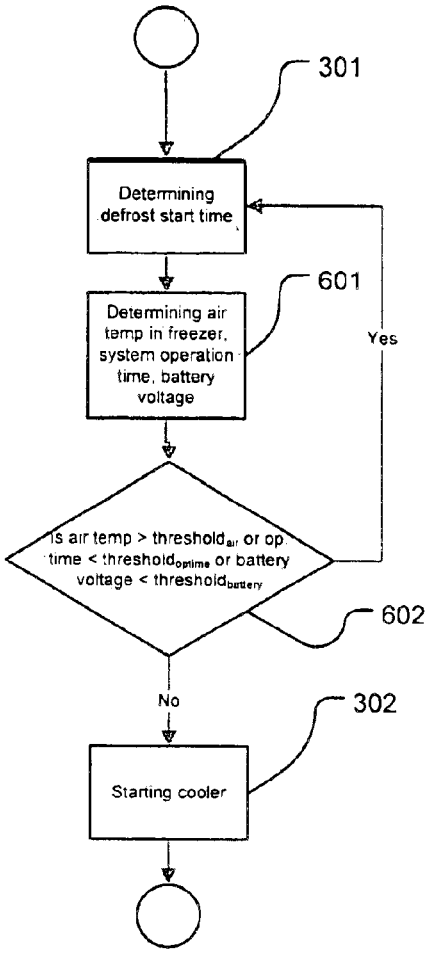

Additionally, as disclosed in FIG. 6, initial determinations regarding specific conditions for the refrigerating system may be performed before commencing defrosting. In step 601 the air temperature in the freezer compartment 109 is measured using the first temperature-measuring device 209, the time period the refrigerator has been operative is measured and the voltage level of the battery 203 is measured. If any of these measurements reveal an unsatisfactory result, that is: if the air temperature is above a threshold, the operating time is below another threshold or the battery voltage level is below a third threshold, the defrosting is postponed by a specified time duration as is indicated in step 602.

Figure 7:
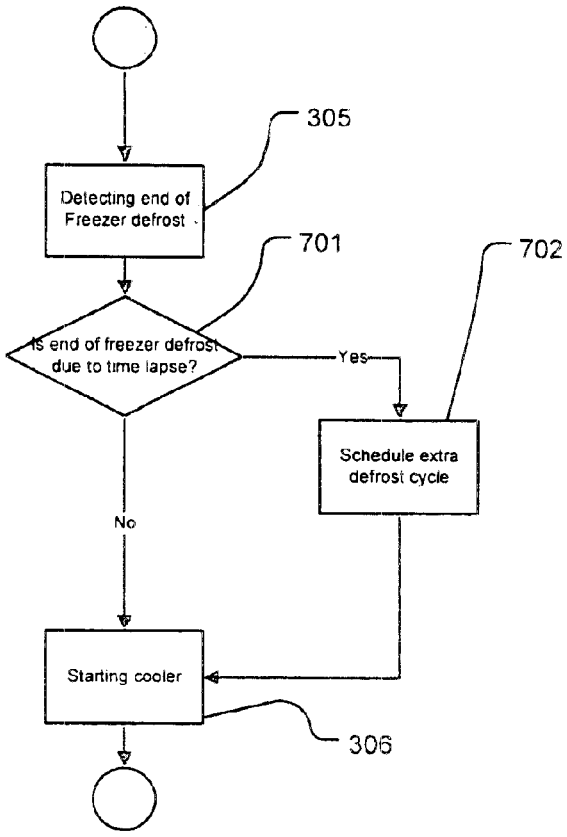

As disclosed in FIG. 7, the end of defrosting of the freezer compartment 109 can be due to lapse of a specific time period. If this is the case, as is checked in step 701, it can be assumed that the defrosting of the freezer compartment 109 has not been effective enough and an extra defrosting is scheduled in step 702. Another criteria to trigger the end of defrosting of the freezer compartment 109, can be a temperature measurement of the first tube section 121, performed by the temperature-measuring device 211. If the temperature of the first tube section 211 is below a threshold the power to the heating element 207 is terminated. In this case no extra defrosting is scheduled.

Alternatively, an alarm may be generated, such as a flashing light or sounding an alarm, if two consecutive defrosting sequences of the freezer compartment is interrupted due to the timer.

Figure 8:
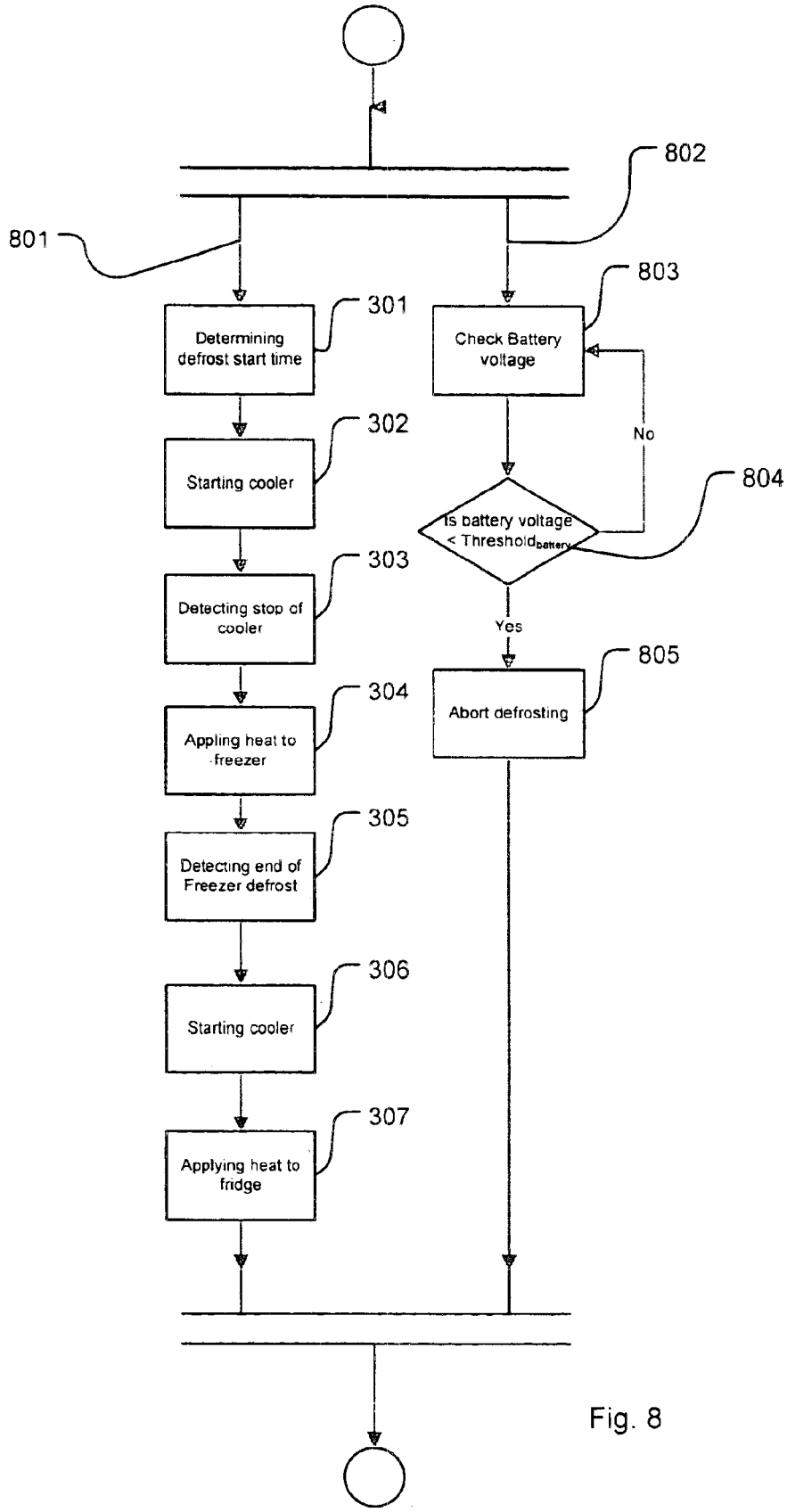

FIG. 8 is a schematic block diagram according to another embodiment of the invention disclosing two parallel processes.

A first process 801 is the defrosting as disclosed in FIG. 3 and will not be described again. Parallel to the first process is a second process 802 running detecting 803 the voltage level of the battery 203 and continuously checking 804 if the battery level falls below a threshold value. If the check 804 is positive, that is the battery level falls below the threshold voltage level, the ongoing defrosting is immediately aborted 805 and a new defrosting may be scheduled.

It should be noted that all different steps disclosed in FIGS. 3 to 8 may be combined in one single control system, or selected parts may be combined to achieve the best defrosting algorithm for the specific application.

Examples of specific parameter values for the defrosting scheme according to the present invention are provided in the table below. It should be noted that the specific figures mentioned are only examples and may be different for other applications or environments.

```
RemoveTriangle(t)
{
    for (i = 0, . . .,2) {
            e ← {t,i};
            h1 ← oprev(e);
            vi ← org(e);
            if (right(hi) = v∞)
                if(oprev(hi) = onext(e)))
                    setRep(vi,Ø);
                else
                    setRep(vi,oprev(oprev(hi)));
            else
                setRep(vi,hi);
    }
    if ((right(h0) ≠ v∞) and
        (right(h1) ≠ v∞) and
```

-continued

```
            (right(h2) ≠ v∞)) {
                e ← MakeEdge(v0,v1);
                Splice(h0,e);
                h0 ← e;
        }
        i ← Ø;
        repeat {
                if (right(hi) = v∞) {
                    Swap(hi);
                    if (right(hi+1) = v∞) {
                        e ← sym(hi+1);
                        Splice(oprev(hi+1),rot⁻¹(e));
                        Splice(oprev(e),onext(e));
                        DestroyEdge(hi+1);
                    }
                    if (right(hi−1) = v∞) {
                        e ← sym(hi−1);
                        Splice(oprev(hi−1),rot⁻¹(e));
                        Splice(oprev(e),onext(e));
                        DestroyEdge(hi−1);
                    }
                    return;
                }
                i ← i+1;
        }
    }
```

It will be obvious that the invention may be varied in a plurality of ways. Such variations are not to be regarded as a departure from the scope of the invention. All such modifications as would be obvious to one skilled in the art are intended to be included within the scope of the appended claims.

What is claimed is:

1. A method for defrosting an absorption refrigerator (1) including a cabinet having outer walls (2, 3, 4, 5, 6) and at least one door (7, 8) encasing a low temperature storage compartment (9), an absorption refrigerating system including an evaporator tube (20) in which a refrigeration medium flows from an upstream end to a downstream end of the evaporator tube, and which evaporator tube comprises a first tube section (21) which is arranged to absorb heat from the low temperature compartment, a first heater provided to heat said first tube section, characterized in the steps of:

determining a defrost start time for defrosting of said low temperature compartment, starting said absorption refrigerating system a first time at said defrost start time independent of other control parameters determining start and stop of said absorption refrigerating system, detecting stop of said absorption refrigerating system, applying heat to said first tube section using said first heater, detecting the temperature of said first tube section, starting said absorption refrigerating system a second time, and detecting end of low temperature compartment defrosting.

2. The method according to claim 1, wherein said step of starting said absorption refrigerating system a second time is performed when the temperature of said first tube section has reached a threshold.

3. The method according to claim 1, wherein said absorption refrigerator comprises, a higher temperature storage compartment (10), said low and higher temperature compartments being separated by a partition wall (11), at least a second tube section (22), which is arranged to absorb heat from the higher temperature compartment, a second heater provided to heat said second tube section comprising the steps of:

determining a defrost start time for defrosting of said low temperature compartment and higher temperature compartment, applying heat to said second tube section using said second heater.

4. The method according to claim 1, wherein

DC-power, e.g. through battery, AC/DC converter etc, is supplied to electronics, such as fans, heaters, control system etc, in said absorption refrigerating system during at least part of the operating time of said absorption refrigerator.

5. The method according to claim 1, wherein:

a delay is introduced between the step of detecting stop of said absorption refrigerating system and said step of applying heat to said first tube section.

6. The method according to claim 1, wherein:

the step of detecting end of low temperature compartment defrosting is performed by detecting the temperature of said first tube section and detecting if a specified time period has elapsed and determining if said temperature is above a threshold or if said specified time period has elapsed.

7. The method according to claim 2, wherein:

the step of applying heat to said second tube section is performed when the start-up sequence for said absorption refrigerating system has finished.

8. The method according to claim 2, wherein:

the step of applying heat to the second tube section is commenced when heat application to the first tube section is ceased.

9. The method according to claim 3, wherein:

the step of applying heat to said second tube section is performed while the absorption refrigerating system is operating.

10. The method according to claim 9, wherein:

detecting end of higher temperature compartment defrosting by detecting the temperature on said second tube section and detecting if a specified time period has elapsed and determining if said temperature is above a threshold or if said specified time period has elapsed.

11. The method according to claim 9, wherein:

said absorption refrigerator comprises a water drain pipe and wherein at least one heating element is arranged in said water drain pipe, and comprising the step of:

resuming normal thermostatic operation after said step of detecting end of higher temperature compartment defrosting, and continue to apply power to said at least one heating element arranged in said water drain pipe.

12. The method according to claim 11, wherein:

said application of heat to said at least one heating element in said water drain pipe is stopped after a specific time period.

13. The method according to claim 1, wherein:

said step of determining a defrost start time is performed by selecting a defrost start time once every 24 hours.

14. The method according to claim 2, comprising the steps of:

detecting the air temperature in said low temperature compartment, detecting the time the absorption refrigerator has been switched on, detecting if cooling energy source is available, detecting the battery voltage, and postponing the defrosting if the air temperature in said low temperature compartment is above a specified temperature or if the absorption refrigerator has been switched on shorter than a specified time or if the battery voltage is below a specified voltage level or if no energy source for cooling is available.

15. The method according to claim 13, wherein:

scheduling an extra defrosting cycle if end of defrosting of said low temperature compartment is determined by lapse of said specified time period.

16. The method according to claim 14, comprising the step of:

detecting battery voltage during the defrosting cycle and aborting the defrosting if said battery voltage level falls under a specified voltage threshold.

17. The method according to claim 1, wherein said low temperature compartment comprises a fan, comprising the step of:

said step of determining a defrost start time is performed by detecting if said fan is blocked and start a defrost cycle if said-fan is blocked.

18. The method according to claim 1, wherein said low temperature compartment comprises a fan, comprising the step of:

starting said fan intermittently for short periods during defrosting of said low temperature compartment.

19. An absorption refrigerator comprising means to perform the steps according to any of the claims above.

* * * * *

UNITED STATES PATENT AND TRADEMARK OFFICE

CERTIFICATE OF CORRECTION

PATENT NO. : 7,131,282 B2
APPLICATION NO. : 10/758175
DATED : November 7, 2006
INVENTOR(S) : Arne Karisson et al.

It is certified that error appears in the above-identified patent and that said Letters Patent is hereby corrected as shown below:

Please delete the formulas beginning at Column 10, Line 53 and ending at Column 11, Line 25, and insert therefor the attached table.

Signed and Sealed this

First Day of May, 2007

JON W. DUDAS
*Director of the United States Patent and Trademark Office*

| | |
|---|---|
| Start time for defrosting | 1:00 AM |
| Minimum "power ON"-time before defrosting | 24 hours |
| Temperature for start condition (air temp in freezer) | < -8° C |
| Battery voltage for start condition | > +11 Volt |
| Delay for new start attempt | 10 minutes |
| Maximum time start attempts after normal time | 3 hours |
| Delay of extra scheduled defrosting after an ordinary defrosting | 6 hours |
| Maximum cooling time before defrosting (step 302 in Figure 3) | 1 hour |
| Relax time (step 401 in figure 4) | 10 minutes |
| Maximum heating time in freezer (step 304 in Figure 3) | 75 minutes |
| Temperature condition to interrupt heating phase in freezer | +5 ° C |
| Maximum heating time in fridge (step 307 in figure 3) | 20 minutes |
| Temperature condition to interrupt heating in fridge (step 307 in Figure 3) | +5 ° C |
| Post-heating time for water drain pipes (step 503 in Figure 5) | 30 minutes from freezer defrost stop |
| Time limit for continuing defrosting after a power break during defrosting | 1 hour |
| Delay before an extra defrosting due to an incomplete defrosting (step 702 in Figure 7) | 6 hours |

| | |
|---|---|
| Start time for defrosting | 01:00 AM |
| Minimum "power ON"-time before defrosting | 24 hours |
| Temperature for start condition (air temp in freezer) | < -8°C |
| Battery voltage for start condition | > +11 Volt |
| Delay for new start attempt | 10 minutes |
| Maximum time start attempts after normal time | 3 hours |
| Delay of extra scheduled defrosting after an ordinary defrosting | 6 hours |
| Maximum cooling time before defrosting (step 302 in figure 3) | 1 hours |
| Relax time (step 401 in figure 4) | 10 minutes |
| Maximum heating time in freezer (step 304 in figure 3) | 75 minutes |
| Temp. condition to interrupt heating phase in freezer | +5°C |
| Maximum heating time in fridge (step 307 in figure 3) | 20 minutes |
| Temp. condition to interrupt heating in fridge (step 307 in figure 3) | +5°C |
| Post-heating time for water drain pipes (step 503 in figure 5) | 30 minutes from freezer defrost stop |
| Time limit for continuing defrosting after a | 1 hours |

| | |
|---|---|
| power break during defrosting | |
| Delay before an extra defrosting due to an incomplete defrosting (step 702 in figure 7) | 6 hours |